United States Patent [19]

Iimura et al.

[11] Patent Number: 4,724,305

[45] Date of Patent: Feb. 9, 1988

[54] DIRECTLY-HEATING ROLLER FOR FUSE-FIXING TONER IMAGES

[75] Inventors: Tsutomu Iimura, Tokyo; Ryoichi Shibata; Yukiharu Takada, both of Saitama, all of Japan

[73] Assignee: Hitachi Metals, Ltd., Tokyo, Japan

[21] Appl. No.: 837,178

[22] Filed: Mar. 7, 1986

[51] Int. Cl.[4] ..... B21B 27/06

[52] U.S. Cl. ..... 219/469; 219/216; 219/244; 219/543; 338/309

[58] Field of Search ..... 219/469–471, 219/244, 216, 543; 338/308, 309

[56] References Cited

U.S. PATENT DOCUMENTS

| | | | |
|---|---|---|---|
| 3,425,864 | 1/1969 | Morey | 427/34 |
| 3,557,576 | 1/1971 | Baum | 65/33 |
| 3,612,170 | 10/1971 | Lyon | 219/469 X |
| 3,649,810 | 3/1972 | Tsuboi et al. | 219/469 X |
| 3,679,473 | 7/1972 | Blatchford et al. | 427/96 |
| 3,794,518 | 2/1974 | Howell | 428/428 |
| 3,968,347 | 7/1976 | Isoard | 219/469 X |
| 4,060,663 | 11/1977 | Merz et al. | 428/428 |
| 4,112,193 | 9/1978 | Higuchi et al. | 428/697 |
| 4,136,611 | 1/1979 | Watanabe | 219/469 X |
| 4,299,887 | 11/1981 | Howell | 428/428 |
| 4,395,109 | 7/1983 | Nakajima et al. | 219/469 X |
| 4,465,727 | 8/1984 | Fujita et al. | 428/138 |
| 4,596,920 | 6/1986 | Inagaki | 219/469 X |

FOREIGN PATENT DOCUMENTS

| | | |
|---|---|---|
| 1903986 | 12/1971 | Fed. Rep. of Germany . |
| 992103 | 6/1951 | France . |
| 1377471 | 11/1965 | France . |
| 60-140693 | 7/1985 | Japan . |
| 1057982 | 5/1966 | United Kingdom . |

*Primary Examiner*—J. R. Scott
*Assistant Examiner*—Jeffrey A Gaffin
*Attorney, Agent, or Firm*—Finnegan, Henderson, Farabow, Garrett, & Dunner

[57] ABSTRACT

The roller has a roller body having a small heat capacity, a bonding layer formed substantially uniformaly on the outer peripheral surface of the roller body, a lower insulating layer provided on the bonding layer; a heat generating layer provided on the lower insulating layer and having a ceramic matrix and a metallic resistance layer constituted by a metal dispersed in the ceramic matrix, the metallic resistance layer extending substantially continuously in the lengthwise direction of the roller, the heat generating layer having a thermal expansion coefficient substantially the same that of the lower insulating layer, an upper insulating layer provided on the heat generating layer, a protective layer formed on the upper insulating layer so as to prevent offset of the toner images, and an electrode layer formed on each end of the roller and adapted to connect the heat generating layer to an external power source.

20 Claims, 8 Drawing Figures

×400

×400

DIRECTLY-HEATING ROLLER FOR FUSE-FIXING TONER IMAGES

BACKGROUND OF THE INVENTION

Electrophotographic copiers and printers make use of toners for developing electrostatic latent images. The developed images are fixed on sheets or the like members to form permanent visual images. Broadly, there are two types of method for fixing the developed images: namely, a method called "heat fuse-fixing" in which resin particles in the toner are heated and fused on the sheet, and a method called "pressure fuse-fixing" in which resin particles are fused by application of pressure.

On the other hand, a device which is referred to as "heat roller fixing device" has been broadly used because of its superior characteristics, namely, stable fixing performance over wide speed range of developing machine, high thermal efficiency and safety. This device has a heat roller which is heated by a tungsten halogen lamp provided inside the roller. This constitution undesirably requires a large electric power consumption and long warm-up time. In addition, the roller temperature is lowered when many sheets are treated successively, because the heat output of the lamp cannot compensate for the temperature drop of the roller.

Thus, shorter warm-up time, reduced electric power consumption and smaller temperature drop are important requisites for the heat roller. More practically, the warm-up time is preferably 30 seconds, more preferably 20 seconds or shorter, while the electric power consumption is preferably less than 1 KW, more preferably about 700 W or smaller. It is also preferred that the roller temperature is stably maintained around 200° C.

In order to develop a heat roller which can be heated up in the short time mentioned above, after an intense study, it was proposed that, from a view point of electric resistivity, a resistance film produced from an Ni-Cr alloy and a ceramic material by arc-plasma spraying method can suitably be used as a heat generator for this type of heat roller. (see copending patent application Ser. No. 686,850 assigned to the same assignee).

In the case of a heat roller which has a short warmup time, the roller temperature is raised to about 200° C. in a very short time of 30 seconds or less as stated above. As a consequence, a considerably heavy thermal shock is repeatedly applied to the roller. Unfortunately, however, the above-mentioned resistance film prepared by arc-plasma spraying of the Ni-Cr alloy and the ceramic material, cannot withstand such a repetition of heavy thermal impact.

Another important requisite for the heat roller is that the roller exhibit a uniform temperature distribution over its entire surface. Generally, the heat roller tends to exhibit higher temperature at its mid portion than at both axial ends. This tendency is increased particularly when the resistance film has a positive temperature coefficient, i.e., such a characteristic that the electric resistance is increased in accordance with a temperature rise. Namely, in such a case, the portion of the resistance film on the mid portion of the roller exhibits a greater resistance than the film portions on both axial ends of the roller, so that the electric current which flows from one to the other axial ends encounters a greater resistance at the mid portion of the roller. Greater heat is generated at this portion of the roller thereby causing a further temperature rise at the mid portion of the roller. In order to attain a uniform temperature rise, therefore, it is preferred that the resistance film does not have a large positive temperature coefficient.

The resistance film could have a negative temperature coefficient, that is, such a characteristic that electric resistance decreases as temperature rises. In such a case, the heat generation is smaller at the mid portion of the roller than at both axial end portions of the same, and could theoretically contribute to a more uniform temperature distribution along the axis of the roller. However, when the roller temperature is still low, the resistance film exhibits a very large electric resistance such as to restrict the flow of the electric current, so that an impractically long time is required for heating up the roller. Thus, the use of a resistance film having a negative temperature coefficient does not meet the demand for shortening of the warm-up time. The control of the temperature of the resistance film is conducted by a control circuit which judges the film temperature by sensing the electric current, and varying the electric current in accordance with the measured temperature so as to maintain a constant film temperature. The resistance film having a negative temperature coefficient reduces its resistance when the temperature becomes high. If the electric resistance of a circuit for supplying the electric power is increased due to an unexpected reason such as an insufficient contact of terminals or contacts in the circuit, the temperature control circuit erroneously judges that the resistance film temperature has come down and operates to supply greater electric current to the resistance film. From the view point of stability of the temperature control, therefore, it is preferred that the resistance film have a positive temperature coefficient.

SUMMARY OF THE INVENTION

Accordingly, an object of the invention is to provide a directly-heating roller for fuse-fixing toner images, which has an extremely short warm-up time and high durability against repeated thermal shock, over conventional directly-heating fuse-fixing rollers.

Another object of the invention is to provide a directly-heating roller provided with a resistance film which has a slight positive temperature coefficient.

To these ends, according to an aspect of the invention, there is provided a directly-heating roller for fuse-fixing toner images comprising: (a) a roller body having a small heat capacity; (b) a bonding layer formed substantially uniformly on the outer peripheral surface of the roller body; (c) a lower insulating layer provided on the bonding layer; (d) a heat generating layer provided on the lower insulating layer and having a ceramic matrix and a metallic resistance layer constituted by a metal dispersed in the ceramic matrix, the metallic resistance layer extending substantially continuously at least in the lengthwise direction of the roller, the heat generating layer having a thermal expansion coefficient substantially the same as that of the lower insulating layer; (e) an upper insulating layer provided on the heat generating layer; (f) a protective layer formed on the upper insulating layer so as to prevent offset of the toner images; and (g) an electrode layer formed on each end of the roller and adapted to connect the heat generating layer to an external power source.

According to the invention, the heat generating layer has a ceramic matrix and a metallic resistor embedded in the matrix, the metallic resistor extending continuously at least in the longitudinal direction. This heat generating layer has a thermal expansion coefficient which is substantially the same as the insulating material. Thus, the heat generating layer has an adequate resistivity, and directly-heating roller can withstand the repeated thermal shocks.

DESCRIPTION OF THE PREFERRED EMBODIMENTS

Figure 1:
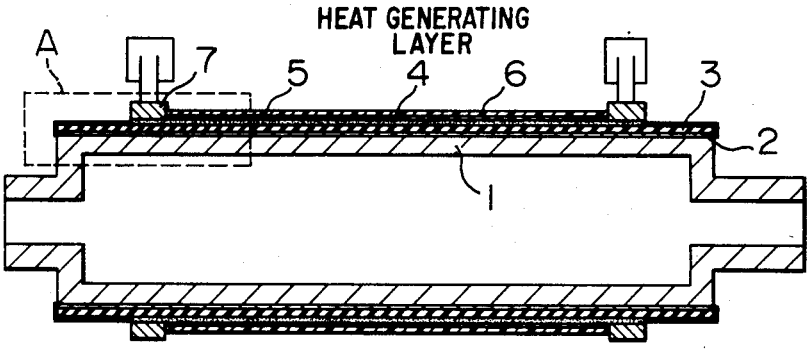
FIG. 1 is a vertical sectional view of a directly heating roller.
Figure 2:
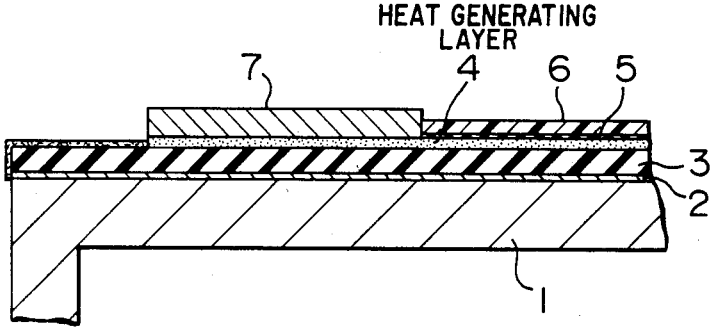
FIG. 2 is an enlarged view of an essential portion of the directly-heating roller shown in FIG. 1.

Referring to FIGS. 1 and 2, a bonding layer 2 is deposited substantially uniformly onto the outer peripheral surface of the roller portion of a cylindrical roller body 1. A lower insulating layer 3 is deposited on the bonding layer 2, and a heat generating layer 4 is formed on the lower insulating layer 3. An upper insulating layer 5 is formed on the heat generating resistance layer 4. Finally, a protective layer 6 is provided on the upper insulating layer 5. An electrode layer 7 is formed on the portion of the heat generating resistance layer 4 on each axial end portion of the roller 1. Thus, electricity is supplied to the heat generating resistance layer through the electrode layers 7 provided on both axial end portions of the roller body 1.

The directly-heating roller having the described construction, when incorporated in a copier or a similar machine, is journaled at its both ends by bearings for rotation. The directly-heating roller is arranged to oppose a rubber roller such as to form therebetween a nip through which a sheet carrying a toner image is passed so that the toner images are fixed.

Preferably, the heat generating resistance layer 4 is formed from a material having a composition containing 10 to 35 wt. % of an Ni-Cr alloy and the balance substantially a ceramic material. The heat generating resistance layer 4 is produced from the above-mentioned material by arc-plasma spraying, such that the Ni-Cr alloy is dispersed so as to form a lengthwise continuous layer in the ceramic material. When the Ni-Cr alloy content is below 10 wt. %, the alloy is dispersed discontinuously, so that the continuous lengthwise layer cannot be formed, with a result that the heat generating resistance layer exhibits a very large resistance. In addition, cracks are apt to be caused around the discontinuities of the heat generating resistance layer, as the roller is subjected to repeated thermal shocks during operation. On the other hand, when the Ni-Cr alloy content exceeds 35 wt. %, the specific resistance of the heat generating layer is as low as $10^{-3}$ ohm-cm at the greatest, so that the layer 4 cannot materially serve as a heat generating layer. In addition, the thermal expansion coefficient of the layer is increased to a level of $10\times10^{-6}$/ deg. which is too large where compared with that of the heat insulating layers sandwiching the heat generating resistance layer.

Any Ni-Cr alloy ordinarily used as a heat-generating conductive means can be used as the Ni-Cr alloy in the heat generating resistance layer 4. However, in order to obtain a directly-heating roller having a very short warm-up time, it is preferred that the Ni-Cr alloy contains 5 to 20 wt. % of Cr and the balance substantially Ni, although some other additives included in heat generating resistance layer and incidental elements are not excluded.

The ceramic matrix of the heat generating resistance layer is preferably formed from $Al_2O_3$. It has been confirmed that when $Al_2O_3$ is used as the ceramic matrix, the Ni-Cr alloy can be well dispersed in the matrix in such a manner as to form a continuous lengthwise layer.

Figure 3:
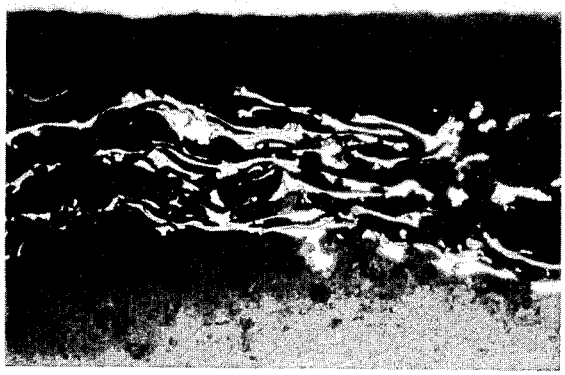
FIG. 3 is a microphotograph of the structure of a heat generating resistance film incorporated in the directly-heating roller in accordance with the invention.
Figure 4:
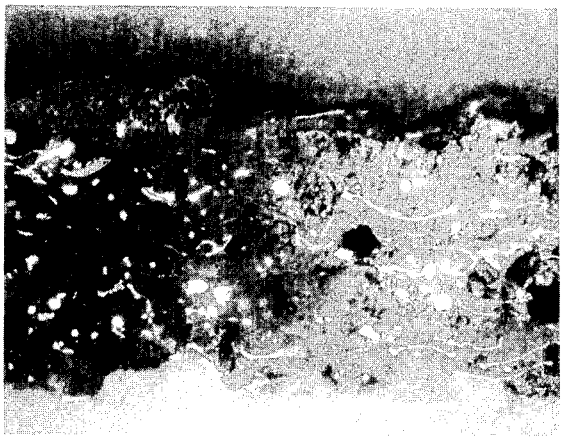
FIG. 4 is a microphotograph of the structure of a reference heat generating resistance film.

Mixtures of Ni-Cr alloys and $Al_2O_3$ were melted and deposited on rollers to form respective layers of 100 μm by an arc-plasma spraying method employing a gas such as Ar, $H_2$ or $N_2$. FIGS. 3 and 4 show, respectively, the microphotos of structures of the layers having Ni-Cr alloy content of 20 wt. % and 8 wt. %, respectively. From FIG. 3, it will be seen that, when the Ni-Cr alloy content is 20 wt. %, lengthwise continuous layers (shown in white color) of Ni-Cr alloy are formed in the ceramic matrix. The continuous layers of Ni-Cr alloy permits the heat generating resistance layer to withstand repeated thermal shock and affords an adequate specific resistance which ranges between about $10^{-1}$ and $10^{-2}$ ohm-cm. On the other hand, the structure shown in FIG. 4 having Ni-Cr alloy content of 8 wt. % cannot have continuous Ni-Cr alloy layer, resulting in a large electric resistance and reduced durability against repeated thermal shocks. The heating material comprising 8 wt. % Ni-Cr alloy is described in Yasuo Tsukuda et al Ser. No. 686,850 assigned to the same assignee.

Since this heat generating resistance layer has a thermal expansion coefficient $\alpha$ of $6\times10^{-6}$ to $10\times10^{-6}$/deg., it is preferred that the insulating layers sandwiching this heat generating resistance layer have a thermal expansion coefficient of not smaller than $6\times10^{-6}$/deg. Insulating layer materials practically usable are; $Al_2O_3$, MgO, $ZrO_2$, $MgAl_2O_4ZrO_2SiO_2$, MnO-NiO, etc. Among these elements, the spinel $MgAl_2O_4$ is preferred because of a high temperature preservation effect which in turn contributes to the shortening of the warm-up time of the roller.

The lower insulating layer electrically insulates the heat generating resistance layer from the roller body and prevents transfer of heat from the resistance layer to the roller body. A too large thickness of the lower insulating layer will result in a long warm-up time of the heating roller because of long time required for heating the lower insulating layer, while a too small thickness cannot provide sufficient electric insulation. For simultaneously satisfying both demands for shorter heatingup time and higher insulation, the thickness of the lower insulating layer preferably ranges between 200 and 500 μm, and most preferably about 300 μm.

The upper insulating layer serves to uniformize the temperature distribution which otherwise does not become uniform due to the non-uniformity of heat generation caused by the partial non-uniformity of heat generating resistor, and serves also to ensure sufficient electric insulation of the roller surface. The upper insulating layer also prolongs the warm-up time when its thickness is too large, and impairs the electric insulation when its thickness is too small. The preferred range of thickness of the upper insulating layer is 30 to 200 μm, more preferably about 100 μm.

Prior art roller bodies are usually made of a high-strength aluminum alloy (5056), in order to meet the demand for high formability, as well as uniform and quick heating characteristics. The directly-heating roller of the present invention, however, has a body which has a small heat capacity. Preferably, the material of the roller body has a thermal expansion coefficient which approximates that of the ceramic. From this point of view, the roller body of the roller in accordance with the invention is made of iron or an iron alloy. As is well known, soft iron exhibits a thermal expansion coefficient value of $12\times10^{-6}$/deg. which is the smallest among those of metals. It is also possible to form the roller body in a cylindrical form which has a small wall thickness of 2 mm or less, preferably 1 mm or less, so as to reduce the heat capacity.

The bonding film bonds the lower insulating layer to the surface of the roller body. Ni-Cr-Mo alloy, Ni-Al alloy, Ni-Cr alloy or the like is suitably used as the material of the bonding surface. When such a material is plasma-sprayed on the surface of the roller body, it generates heat by itself and is partially oxidized to form an oxide which effectively enhances the strength of bonding with the ceramic. Amongst these materials of the bonding film, powdered Ni coated on the surface thereof with Al and Mo is used most preferably.

The protective layer coats the surface of the upper insulating layer, in order to improve the anti-offset characteristics of the roller and also for the purpose of insulating the surface of the roller. Preferably, the protective layer is formed from PFA (tetrafluoroethylene-perfluoroalkylvinyl ether copolymer resin) at a thickness of 30 μm.

Experiment 1

Three cylindrical roller bodies (300 mm long and 35 mm of outer diameter) of soft iron, having wall thicknesses of 0.6 mm, 1.0 mm and 1.5 mm respectively, were prepared. On the surface of each roller body were formed by a plasma spraying process an Ni-4%Al-2%Mo alloy bonding layer of 25 μm thick, a lower $MgAl_2O_4$ insulating layer of 300 μm thick, a heat generating resistance film of 70 μm made of a mixture of an Ni-Cr alloy and $Al_2O_3$ (alloy content 20 wt. %), and an $MgAl_2O_3$ upper insulating layer of 100 μm thick, in turn. After securing the electrodes to both ends of the heat generating resistance film, a PFA protective layer was formed on the upper insulating layer, thus completing the directly-heating roller.

The plasma spray apparatus used in this experiment comprised a gun body having a central path for flowing an operation gas, argon. A part of the path was enclosed by an anode, and a rod-type cathode was mounted in the path. A path for supplying powder mixtures to be sprayed was open to the central path near a nozzle opening.

While the argon was flowing through the central path of the gun, plasma arc was provided between the anode and the cathode. The electrical voltage applied was 50 to 100 V. The arc turned the argon into a high-temperature plasma jet which was more than 5000° C.

Powders to be sprayed were supplied through the side path into the plasma formed in the central path. The roller was rotating to form a uniform deposited layer on it while the roller was placed at the distance of 10 cm from the plasma jet.

When the Ni-Al-Mo alloy plasma-sprayed layer was deposited, the spraying condition is follows:

Arc current: 500 A
Arc voltage: 70 V DC
Powder Supply Rate: 25 lb/hr

When the insulating $Mgal_2O_4$ layer was deposited, the spraying condition is follows:

Arc current: 500 A
Arc voltage: 80 V DC
Powder Supplying Rate: 6 lb/hr

When the heat generating resistance film was deposited, the spraying condition is follows:

Arc current: 500 A
Arc voltage: 80 V DC
Powder Spraying Rate: 6 lb/hr

Figure 5:
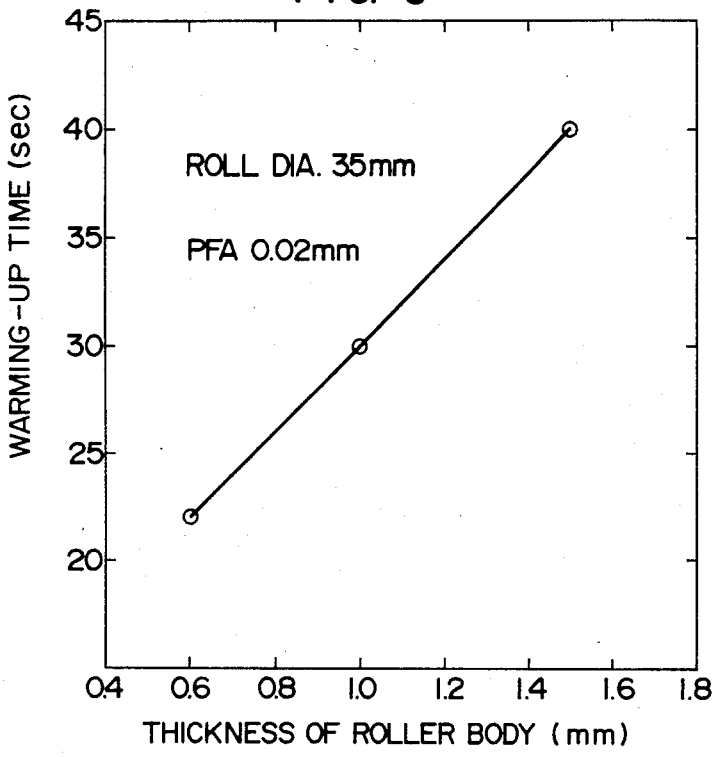
FIG. 5 is a graph showing the relationship between the warm-up time and the thickness of the roller body.

Electric current was supplied to each roller such that it produced a power of 900 Watts, and the period of time required for heating the roller surface up to 200° C. was measured as the warm-up time. As will be seen from FIG. 5, the warm-up time was 40 seconds in the roller having roller body thickness of 1.5 mm, and 30 seconds and 22 seconds, respectively, when the roller body thickness was 1.0 mm and 0.6 mm. It will be seen that the directly-heating roller of the invention has a very short warm-up time.

Experiment 2

Figure 6:
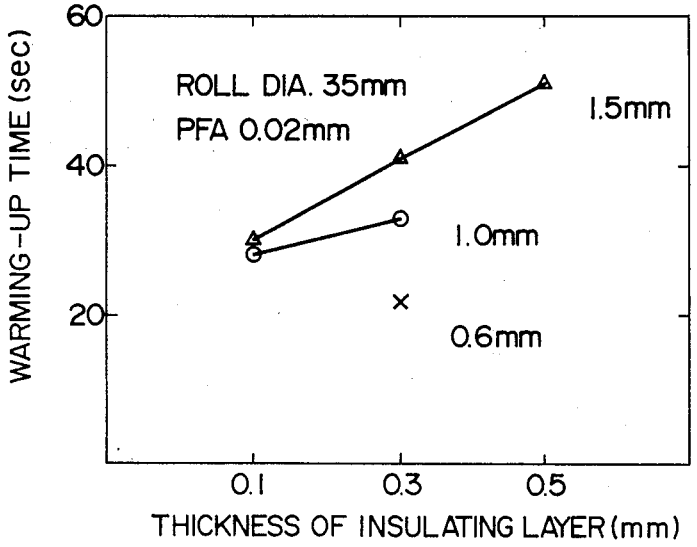
FIG. 6 is a graph showing the relationship between the warm-up time and the insulating layer.

Directly-heating rollers were prepared in the same way as Experiment 1, with the thickness of the lower insulating layer varied as 100 μm, 300 μm and 500 μm. Electric current was supplied to the rollers such that it produced power of 900 Watts and the period of time required for heating the roller surfaces up to 200° C. was measured as the warm-up time. As will be seen from FIG. 6 which shows the result of the measurement, the warm-up time is shortened as the roller body thickness is reduced and as the insulating layer thickness is reduced.

Experiment 3

Figure 7:
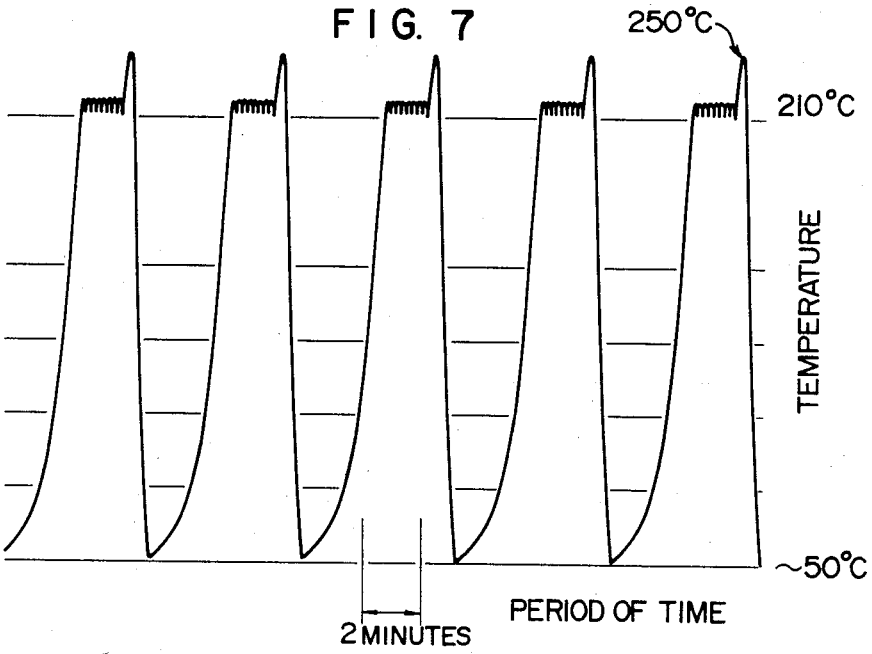
FIG. 7 is a heat cycle chart showing heat cycles employed in a heat cycle test.

The directly-heating roller having the roller body thickness of 0.6 mm employed in Experiment 1 was subjected to a repetitional heat cycle test. In this test, the heating roller was held in contact with a rubber roller of a diameter substantially the same as that of the heating roller, while being rotated at a peripheral speed of 200 mm/sec. The heat cycle test was conducted by applying the roller to repetitional heat cycles as shown in FIG. 7. The heat roller in accordance with the invention showed no breakdown of the resistance layer and no deterioration in the electric characteristics, even after 2600 continous heat cycles.

Experiment 4

A continuous heat-rotation test was carried out by using a fixing unit of the same type as that used in Experiment 3. Neither breakdown of the resistance layer nor deterioration in the electric characteristics were observed after 650-hour operation at the maximum temperature of 220° C., thus proving the superiority of the heating roller of the invention. In a case of a copier which fixes images on 12 sheets of A-4 size paper per minute, it takes about 200 hours for fixing images on 150,000 sheets which is the number guaranteed. It will be seen that the heating roller of the invention can withstand the use for a long period of time which is about 3 times as long as the guaranteed period.

Experiment 5

There were prepared cylindrical roller bodies made of soft iron and having a length of 240 mm, an outer diameter of 35 mm, and a thickness of 0.6 mm. On the surface of the cylindrical bodies were plasma-sprayed a bonding film of Ni-Al-Mo alloy having a thickness of 25 μm, a lower insulating layer of $MgAl_2O_3$ having a thickness of 300 μm, and an exothermic resistance film of about 70 μm in thickness including Ni-Al alloy of 20% and the balance $Al_2O_3$, in turn. However, in one of the rollers designated (A) the resistance film was made to have a thickness of 65–70 μm and to be to have a substantially uniform in the range from the end of the roller to the center thereof, while in another roller designated (B) the resistance film was made to have a thickness of 55 μm at both ends thereof and another thickness of 70 μm at the center. Onto each of these resistance films were plasma-sprayed an upper insulating layer having a thickness of 100 μm and a pair of protective layer of PFA in turn, whereby a directly-heating rollers were produced.

Figure 8:
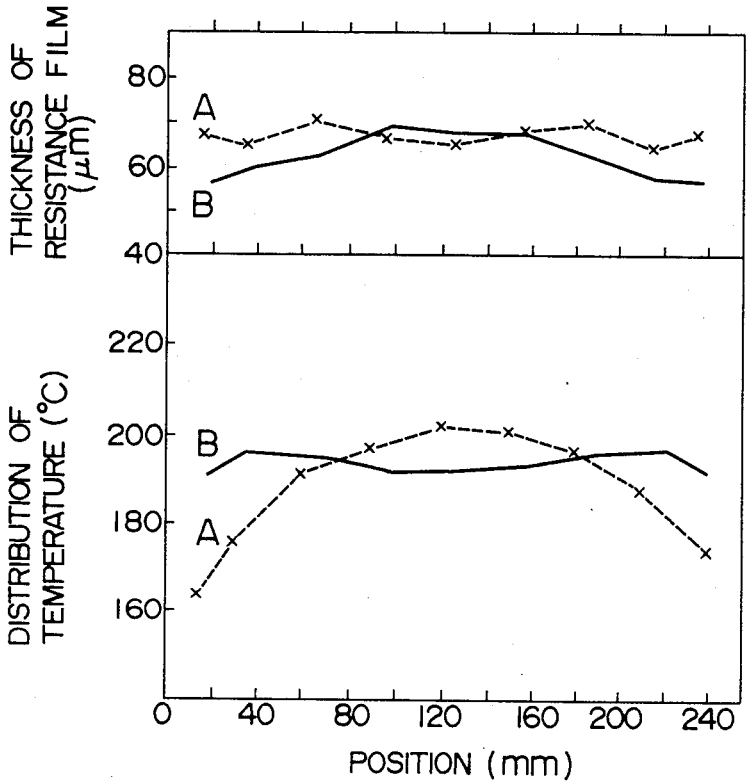
FIG. 8 is a chart illustrating the film thickness distribution and the temperature distribution on the directly-heating roller in accordance with the invention.

After an elapse of 20 minutes from the commencement of feeding electric power to the resultant rollers, there were measured temperature distributions which are shown in the lower part of FIG. 8. As apparent in FIG. 8, from the roller (A) the temperature of the center portion thereof is high and the temperature of the end portions is extremely low, while in the roller (B) the temperature distribution thereof is at the same level.

What is claimed is:

1. A directly-heating roller for fuse-fixing images formed from a toner, the roller comprising:
   (a) a roller body having a small heat capacity;
   (b) a bonding layer formed substantially uniformly on the outer peripheral surface of said roller body;
   (c) a lower insulating layer provided on said bonding layer;
   (d) a heat generating layer provided on said lower insulating layer and having a ceramic matrix and a metallic resistance layer dispersed in said ceramic matrix, said metallic resistance layer consisting essentially of 10 to 35 wt. % of an Ni-Cr alloy, said metallic resistance layer extending substantially continuously in the lengthwise direction of said roller, said heat generating layer having a thermal expansion coefficient substantially the same as that of said lower insulating layer;
   (e) an upper insulating layer provided on said heat generating layer;
   (f) a protective layer formed on said upper insulating layer so as to prevent offset of said toner images; and
   (g) an electrode layer formed on each end of said roller and adapted to connect said heat generating layer to an external power source.

2. A directly-heating roller according to claim 1, wherein said Ni-Cr alloy consists essentially of 5 to 20 wt. % of Cr and the balance substantially Ni.

3. A directly-heating roller according to claim 1 wherein said ceramic is $Al_2O_3$ formed from a molten state.

4. A directly-heating roller according to claim 1, wherein each of said lower insulating layer and said upper insulating layer has a thermal expansion coefficient which is not smaller than $6\times10^{-6}$/deg.

5. A directly-heating roller according to claim 4, wherein said lower insulating layer has a thickness ranging between 200 and 500 μm.

6. A directly-heating roller according to claim 5, wherein said lower insulating layer has a thickness of about 300 μm, while said upper insulating layer has a thickness of about 100 μm.

7. A directly-heating roller according to claim 4, wherein said heat insulating layers are made of an oxide selected from a group consisting of $Al_2O_3$, MgO, $ZrO_2$, $MgAl_2O_4$, $ZrO_2.SiO_2$, and MnO.NiO.

8. A directly-heating roller according to claim 7, wherein said oxide is $MgAl_2O_4$.

9. A directly-heating roller according to claim 7, wherein said oxide is $Al_2O_3$.

10. A directly-heating roller according to claim 1, wherein the roller is made from a material selected from the group consisting of iron and iron alloys.

11. A directly-heating roller according to claim 10, wherein the wall thickness of said roller body is not greater than 2 mm.

12. A directly-heating roller according to claim 10, wherein the wall thickness of said roller body is not greater than 1 mm.

13. A directly-heating roller according to claim 1, wherein said bonding layer is made of a material selected from a group which consists of Ni-Al-Mo alloy, Ni-Al alloy and Ni-Cr alloy, and is partially oxidized.

14. A directly-heating roller according to claim 1, wherein said upper insulating layer has a thickness ranging between 30 and 200 m.

15. A directly-heating roller according to claim 1, wherein said upper insulating layer has a thickness of about 100 m.

16. A directly-heating roller according to claim 1, wherein said heat generating layer is formed by plasma spraying.

17. A directly-heating roller according to claim 1, wherein said ceramic matrix is $Al_2O_3$, and wherein said dispersed Ni-Cr alloy and said $Al_2O_3$ matrix are formed concurrently by plasma spraying a mixture of the Ni-Cr alloy powder and $Al_2O_3$ powder.

18. A directly-heating roller for fuse-fixing images formed form a toner, the roller comprising:
   (a) a hollow cylindrical roller body formed from a material selected from the group consisting of iron and iron alloys and having a wall thickness not greater than 1 mm;
   (b) a bonding layer formed substantially uniformly on the outer peripheral surface of said roller body, said bonding layer being formed from a material selected from a group consisting of Ni-Al-Mo alloy, Ni-Al alloy and Ni-Cr alloy and partially oxidized.
   (c) a lower insulating layer provided on said bonding layer and formed of a ceramic having a thermal expansion coefficient not smaller than $6\times10^{-6}$/deg, said lower insulating layer having a thickness ranging between 200 and 500 m;
   (d) a heat generating layer provided on said lower insulating layer and having matrix formed from molten $Al_2O_3$ and an Ni-Cr alloy resistance layer constituted by an Ni-Cr alloy dispersed in said matrix, said Ni-Cr alloy resistance layer extending substantially continuously in the length-wise direction of said roller;

(e) an upper insulating layer provided on said heat generating layer;

(f) a protective layer formed on said upper insulating layer for preventing offset of said toner images; and (g) an electrode layer formed on each end of said roller and adapted to connect said heat generating layer to an external power source.

19. A directly-heating roller according to claim 18, wherein said insulating layer is made of $MgAl_2O_4$, while said heat generating layer is formed of a material consisting essentially of 10 to 35 wt. % of an Ni-Cr alloy and the balance substantially $Al_2O_3$ ceramic.

20. A directly-heating roller according to claim 18, wherein said insulating layer is made of $Al_2O_3$, while said heat generating layer is made of a material consisting essentially of 10 to 35 wt. % of an Ni-Cr alloy and the balance substantially $Al_2O_3$ ceramic.

* * * * *